US005991943A

United States Patent [19]

Morris

[11] Patent Number: 5,991,943

[45] Date of Patent: Nov. 30, 1999

[54] CORNER CRIB WITH FREE-FLOATING CANOPY

[76] Inventor: JoAnna Morris, 4610 Wilcox Pl., Jamesville, N.Y. 13078

[21] Appl. No.: 09/161,765

[22] Filed: Sep. 28, 1998

[51] Int. Cl.[6] ..... A47D 7/00; A47C 29/00

[52] U.S. Cl. ..... 5/93.1; 5/414; 135/90

[58] Field of Search ..... 5/93.1, 902, 100, 5/414; D6/390, 391; 135/90, 900, 96, 901

[56] References Cited

U.S. PATENT DOCUMENTS

| | | | |
|---|---|---|---|
| 264,761 | 9/1882 | Richardson | 5/414 |
| D. 378,789 | 4/1997 | Morris | D6/390 |
| 2,059,240 | 11/1936 | Johnston | 5/100 |
| 2,501,309 | 3/1950 | Braver | 5/93.1 |
| 2,533,983 | 12/1950 | Weigle et al. | 5/2.1 |
| 2,689,960 | 9/1954 | Lax | 5/93.1 |
| 4,785,837 | 11/1988 | Hansen et al. | 5/414 |
| 5,438,717 | 8/1995 | Wells | 5/414 |
| 5,706,533 | 1/1998 | Opheim et al. | 5/93.1 |

FOREIGN PATENT DOCUMENTS

| | | | |
|---|---|---|---|
| 447457 | 2/1994 | Japan | 5/93.1 |

*Primary Examiner*—Alexander Grosz
*Attorney, Agent, or Firm*—August E. Roehrig, Jr.; Hancock & Estabrook, LLP

[57] ABSTRACT

A crib to be positioned in the corner of a room and which has a crib canopy appearing to be freely floating in the room corner above the crib. The crib includes a storage area with shelves and drawers for maintaining baby necessities close at hand, as well as a receptacle for including a cassette player carried in a position to permit music from the cassette to be directed from the crib. A series of picture holders are positioned along the two side walls of the crib which engage or are supported adjacent the walls of the room, to enable such things as photographs and drawings to be removably displayed therein.

8 Claims, 3 Drawing Sheets

162
162
150
105
100
102a
107
107
102b
102
101
101
117
115

CORNER CRIB WITH FREE-FLOATING CANOPY

BACKGROUND OF THE INVENTION

This invention relates in general to furniture and, in particular, to a crib which is positionable in the corner of a room.

More specifically, but without restriction as to the particular embodiment and/or use which is shown and described herein for purposes of illustration, this invention relates to a crib to be positioned in the corner of a room and which has a crib canopy appearing to be freely floating in the room corner above the crib. The crib includes a storage area with shelves and drawers for maintaining baby necessities close at hand, as well as a receptacle for including a cassette player carried in a position to permit music from the cassette to be directed from the crib. A series of picture holders are positioned along the two side walls of the crib which engage or are supported adjacent the walls of the room, to enable such things as photographs and drawings to be removably displayed therein.

As is known to those who have or who have had children, a crib is a convenient if not indispensable piece of furniture for safely protecting a baby both when the baby is sleeping, and when the baby is awake. To this end, a crib is constructed to properly support a baby when resting on the crib mattress, and to protect the baby as it grows and begins to sit and stand. In addition, a crib functions as a convenient place to change a baby's diapers, eliminating the need for a separate dressing table, and provides a safe playground where a baby can entertain itself during the day between feedings.

To these ends the present invention provides a unique space saving and aesthetically pleasing corner crib which includes storage facilities for baby supplies, and provides a safe environment in which the baby can sleep and entertain itself while awake.

SUMMARY OF THE INVENTION

It is, therefore, an object of this invention to improve baby cribs.

Another object of this invention is to incorporate adequate storage facilities for baby supplies into a crib structure.

A further object of this invention is to incorporate these above objectives in an aesthetically appealing piece of furniture.

Still another object of this invention is to facilitate the ease with which the decor of the crib can be changed.

Yet another object of this invention is to provide a cover for the crib to aid in the appearance thereof and to prevent drafts from impinging on a baby in the crib.

A still further object of this invention is to incorporate a cassette player and speaker into the crib for providing music from pre-recorded tapes to entertain a baby in the crib.

These and other objects are attained in accordance with the present invention wherein there is provided a corner crib to be positioned in the corner of a room and which has a crib canopy appearing to be freely floating above the crib. The crib includes a storage area with shelves and drawers for maintaining baby necessities close at hand, as well as a receptacle for including a cassette player carried in a position to permit music from the cassette to be directed from the crib. A series of picture holders are positioned along the two side walls of the crib which engage with or are supported adjacent the walls of the room, to enable such things as photographs and drawings to be removably displayed therein.

DESCRIPTION OF THE DRAWINGS

Further objects of this invention, together with additional features contributing thereto and advantages accruing therefrom, will be apparent from the following description of a preferred embodiment of the present invention which is shown in the accompanying drawings with like reference numerals indicating corresponding parts throughout and which is to be read in conjunction with the following drawings, wherein.

These and additional embodiments of the invention may now be better understood by referring to the following detailed description of the invention wherein the illustrated embodiments are described.

DETAILED DESCRIPTION OF THE INVENTION

Throughout this description, the preferred embodiment and examples shown should be considered as exemplars, rather than limitations on the apparatus of the present invention.

Figure 1:
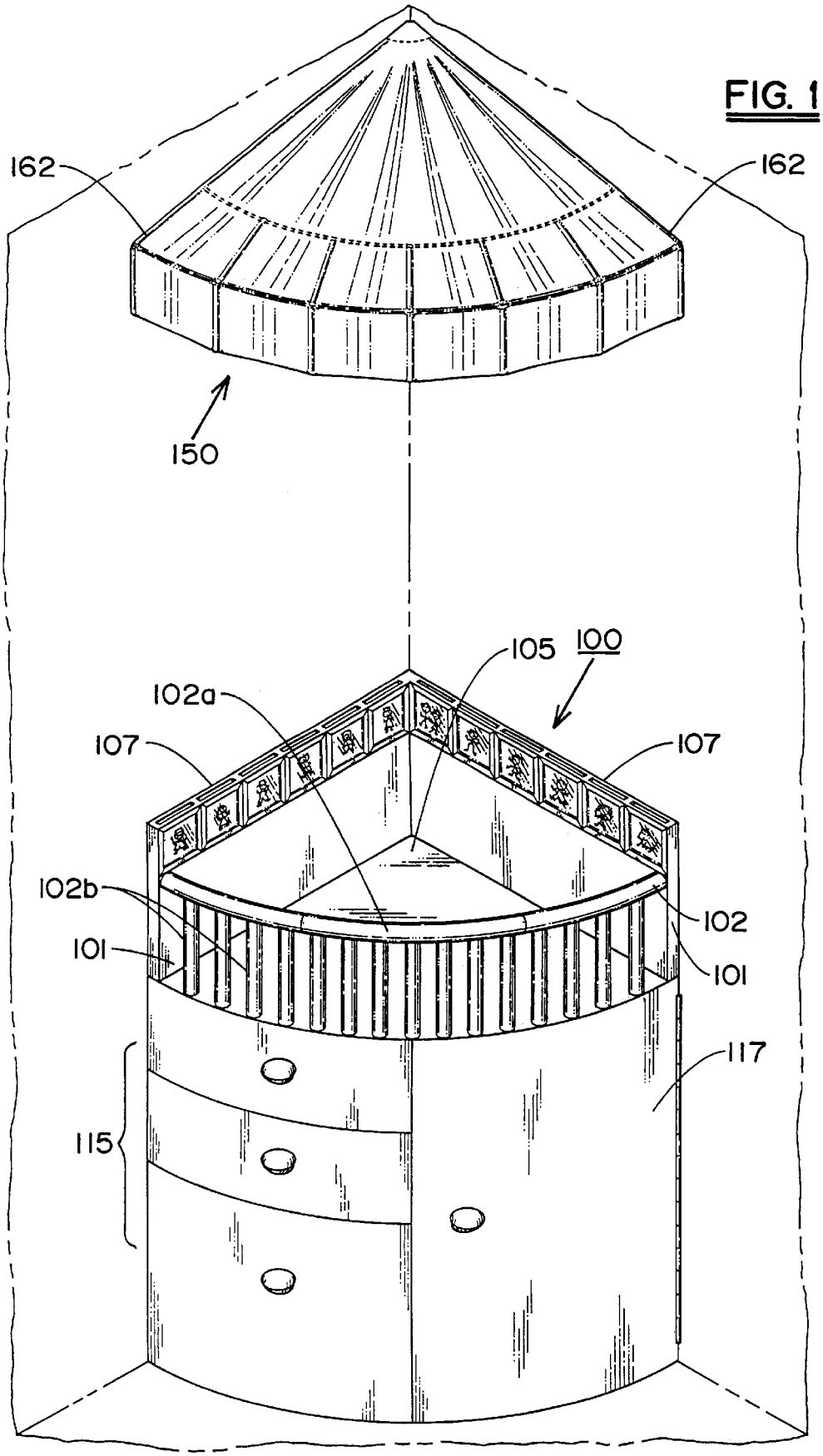
FIG. 1 is a frontal perspective view of the corner crib.
Figure 3:
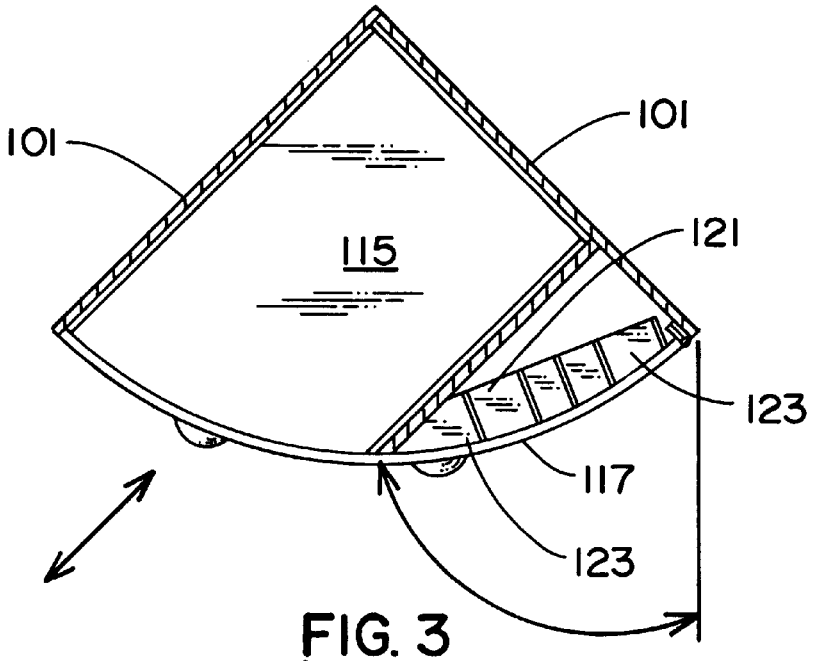
FIG. 3 is a horizontal sectional view of the corner crib taken along lines 3—3 with portions removed to better illustrate the internal construction of the drawers and shelving thereof.
Figure 2:
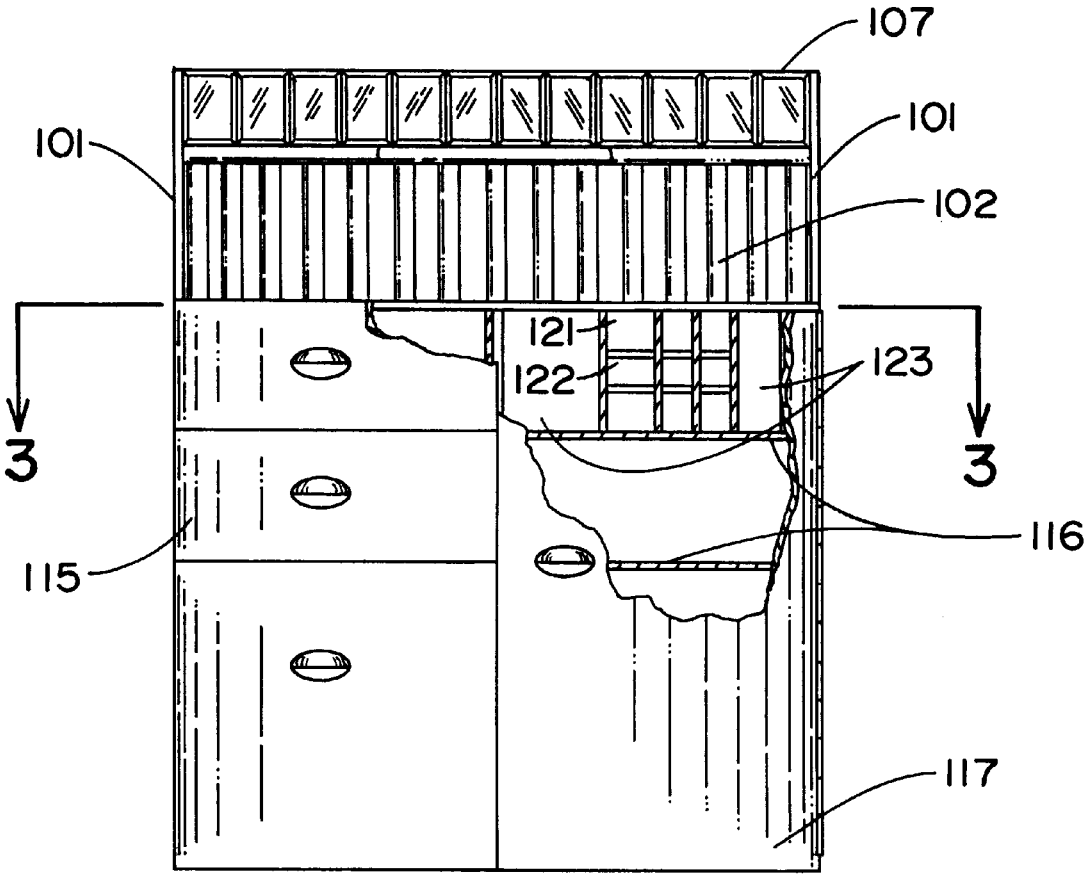
FIG. 2 is a frontal elevational view of the corner crib with the door and drawers closed and portions removed to better illustrate the internal construction of the drawers and shelving.
Figure 4:
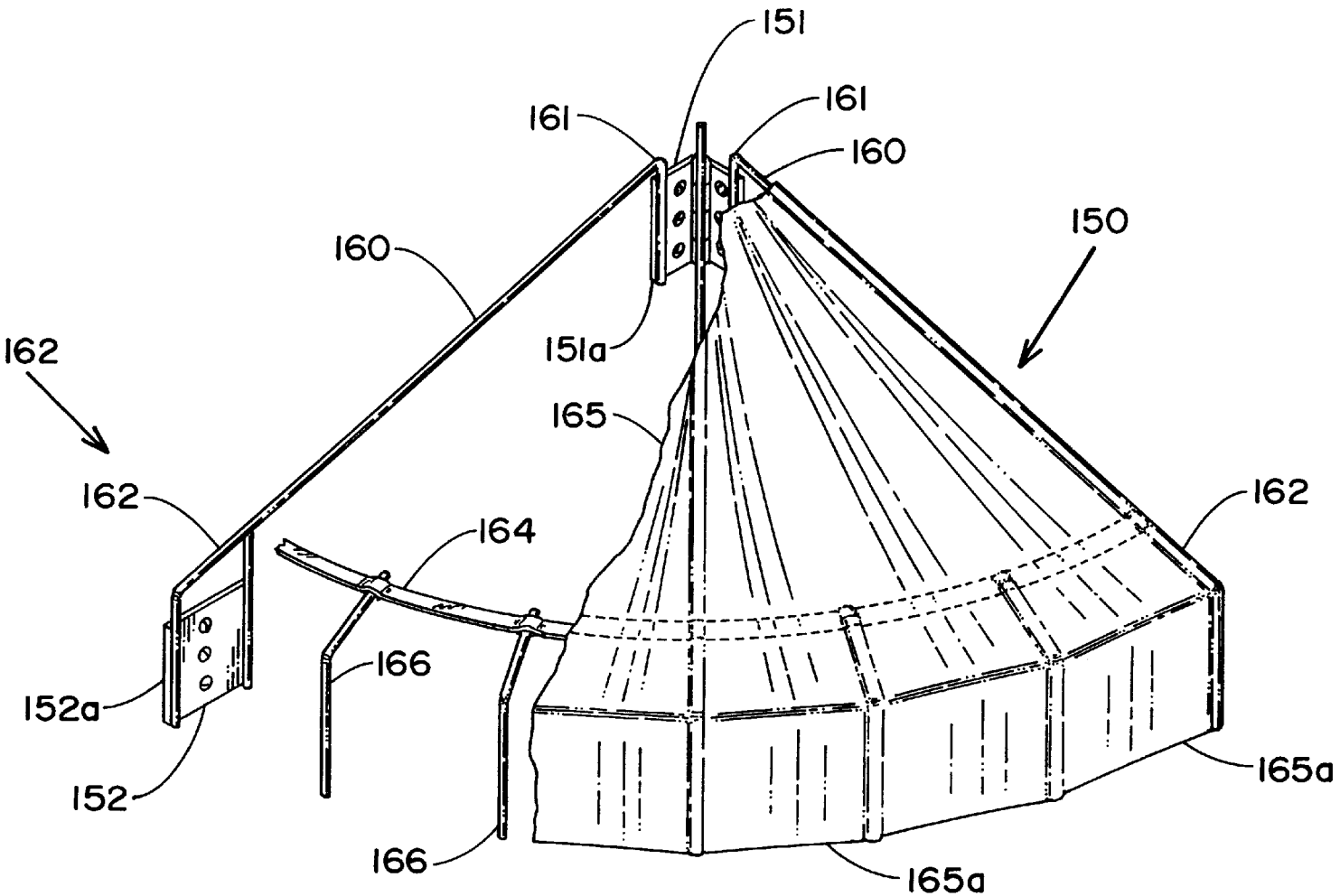
FIG. 4 is a frontal perspective view of the support structure for the crib canopy with portions broken away to better illustrate the manner in which the crib canopy is supported.

Referring now to the drawings, there is shown in FIG. 1 a corner crib 100 having a pair of side walls 101 positioned substantially in perpendicular engagement with each other for positioning adjacent to intersecting walls forming a corner of a room in which the corner crib 100 is to be placed. A front or connecting wall 102 extends between an end of each of the side walls 101 to complete an enclosure defined by these walls. Each end of the side walls 101 and the front connecting wall 102 includes a suitable connector for joining the side walls 101 to each other at one end thereof, and for joining the opposed end of each side wall to the front wall 102. While the preferred embodiment of the corner crib as illustrated in the drawings utilizes a curved connecting wall 102 to join the two side walls 101, it is to be understood that the connecting wall 102 could be straight instead of the illustrated curve. A platform 105 or base is secured to the side walls 101 and the connecting wall 102 forming a base upon which a mattress, not shown, is placed for supporting a baby. The base 105 is vertically displaceable relative to the side walls 101 and connecting wall 102 for adjusting the depth of the crib for convenience of attending to a baby, and to insure the baby's safety as the baby grows. A row of individual picture frames 107 is positioned along and above each of the side walls 101 to permit the interchanging of decorations, graphic materials and/or photos.

While it is not essential, in the preferred embodiment of the corner crib 100, a central section 102*a* of the connecting or front wall 102 is vertically moveable in the manner of a conventional drop or folding gate crib to facilitate access to the crib interior. Such movement of the center section can be accomplished by providing a retaining latch to hold the center section 102*a* when raised in the position illustrated, and a series of opening in the base 105 through which the vertical posts 102*b* of section 102*a* may pass when the center section 102*a* is lowered, in the manner of a drop gate crib. In the alternative, a similar latch may be provided with one or more of the vertical posts 102*b* being hinged to the base 105 such that the central section 102*a* can be pivoted outwardly and downwardly to facilitate access to the crib interior.

Beneath the platform base 105 is a storage facility for storing baby supplies, comprising a series of storage drawers 115 and shelves 116. A door 117 is hingedly supported for pivotal movement to provide access to the shelves 116, while providing a closure to protect and hide the contents thereof. A portion 121 of the shelf space is partitioned to provide space for a cassette player, cassette tape storage 122 and speakers 123.

Positioned above the platform base 105, side walls 101, and front or connecting wall 102 is a canopy 150 which appears to be freely floating above the crib 100. The canopy 150 is supported by the walls of the room adjacent to the side walls 101 of the crib 100. To this end, a hinge 151 is secured to the walls of the room adjacent to the intersection thereof. Each end of the hinge 151 is formed with a receptacle 151*a* into which an end 161 of a canopy support rod 160 is placed for supporting a canopy of cloth material 165 above the corner crib 100. The opposite or outer end 162 of each canopy support rod 160 is sized to be received into a receptacle 152*a* of a support bracket 152. The support brackets 152 are securable to the walls of the room at a position spaced from the intersection thereof as determined by the length of the canopy support rods 160. A valence support rod 164 extends between the canopy support rods 160 adjacent to the outer ends 162 thereof, and supports a series of depending spacers 166 which support the canopy of cloth material to form a downwardly extending skirt portion 165*a*.

While this invention has been described in the specification and illustrated in the drawings with reference to a preferred embodiment, the structure of which has been disclosed herein, it will be understood by those skilled in the art to which this invention pertains that, various changes may be made and equivalents may be substituted for elements of the invention without departing from the scope of the claims. Therefore, it is intended that the invention not be limited to the particular embodiment disclosed in the specification and shown in the drawings as the best mode presently known by the inventor for carrying out this invention, nor confined to the details set forth, but that the invention will include all embodiments, modifications and changes as may come within the scope of the following, claims:

It is claimed:

1. A corner crib and storage unit positionable adjacent to intersecting walls forming a corner of a room comprising:

a pair of intersecting sidewalls joined together at one end for forming two sides of a crib and storage unit;

a connecting wall joined to each one of said pair of intersecting sidewalls for forming an enclosing side of the crib and storage unit;

a crib bottom wall positioned adjacent to and supported from said sidewalls and said connecting wall for forming a crib bottom upon which a mattress may be supported;

said connecting wall extending in a curve between the points of-joinder with said sidewalls with the curve being formed in a substantially constant radius from the point of joinder of said intersecting sidewalls;

said connecting wall having a central gate forming portion to facilitate access to a crib enclosure portion of the crib interior;

a crib enclosure portion of the crib interior formed between an upper portion of said sidewalls, said central gate portion of said connecting wall and said crib bottom wall;

said central gate portion of said connecting wall being moveable relative to the remainder of said connecting wall to provide access to said crib enclosure portion of the crib interior;

a plurality of storage drawers positioned beneath said crib bottom and supported by said sidewalls and said connecting for sliding movement into and out from beneath said crib bottom;

a storage area beneath said crib bottom including a plurality of shelves;

a door supported by one of said sidewalls adjacent to said storage area and forming a closure therefor;

a canopy positioned above and over said sidewalls and said crib enclosure portion; and said canopy including a hinge adapted to be secured to said intersecting walls forming a corner of a room, a support bracket adapted to be secured to each one of said intersecting walls and a canopy support rod extending between said hinge and each one of said support brackets for securing said canopy to said intersecting walls at a position above said sidewalls and said crib enclosure portion.

2. The corner crib of claim 1 wherein said front connecting wall includes a portion thereof moveable relative to said base and the remaining portion of said connecting wall to facilitate access to the enclosure formed by the joinder of said sidewalls and said base.

3. The corner crib of claim 1 flier including a graphic materials display retainer positioned adjacent to at least one of said sidewalls for interchangeably displaying graphic materials therein.

4. The corner crib of claim 1 wherein said storage area formed beneath said base includes a plurality of shelves.

5. The corner crib of claim 1 wherein said central gate portion is moveable relative to said crib bottom wall and the remaining portion of said connecting wall to facilitate access to the crib enclosure portion of the crib interior.

6. The corner crib of claim 1 further including a graphic materials display retainer positioned adjacent to and above each of said sidewalls for interchangeably displaying graphic materials therein.

7. The corner crib of claim 5 wherein said central gate portion is vertically moveable relative to said crib bottom wall and the remaining portion of said connecting wall.

8. The corner crib of claim 5 wherein said central gate portion is pivotal outwardly and downwardly from the remaining portion of said connecting wall.

* * * * *

UNITED STATES PATENT AND TRADEMARK OFFICE

CERTIFICATE OF CORRECTION

PATENT NO. : 5,991,943

DATED : Nov. 30, 1999

INVENTOR(S) : JoAnna Morris

It is certified that error appears in the above-indentified patent and that said Letters Patent is hereby corrected as shown below:

In The Claims:

Claim 3, line 1: Delete "flier" and substitute therefore --further--.

Signed and Sealed this

Eighth Day of May, 2001

*Attest:*

Nicholas P. Godici

NICHOLAS P. GODICI

*Attesting Officer*

*Acting Director of the United States Patent and Trademark Office*